US010138669B2

(12) United States Patent
Vanini

(10) Patent No.: US 10,138,669 B2
(45) Date of Patent: Nov. 27, 2018

(54) ACTUATING SYSTEM FOR A DOOR OF AN ELECTRICAL DOMESTIC APPLIANCE

(71) Applicant: NUOVA STAR S.p.A., Zola Predosa (Bologna) (IT)

(72) Inventor: Marco Vanini, Bologna (IT)

(73) Assignee: NUOVA STAR S.P.A., Zola Predosa (IT)

( * ) Notice: Subject to any disclaimer, the term of this patent is extended or adjusted under 35 U.S.C. 154(b) by 0 days.

(21) Appl. No.: 15/464,637

(22) Filed: Mar. 21, 2017

(65) Prior Publication Data

US 2017/0298674 A1 Oct. 19, 2017

(30) Foreign Application Priority Data

Apr. 15, 2016 (IT) ..... 102016000039160

(51) Int. Cl.

| | |
|---|---|
| ***E05F 15/627*** | (2015.01) |
| ***A47L 15/42*** | (2006.01) |
| ***E05F 1/12*** | (2006.01) |
| ***E05F 1/14*** | (2006.01) |
| ***F24C 15/02*** | (2006.01) |

(Continued)

(52) U.S. Cl.

CPC ..... *E05F 15/627* (2015.01); *A47L 15/4261* (2013.01); *E05F 1/1261* (2013.01); *E05F 1/14* (2013.01); *E05F 15/616* (2015.01); *E05F 15/622* (2015.01); *F24C 15/023* (2013.01); *E05Y 2900/30* (2013.01); *E05Y 2900/308* (2013.01)

(58) Field of Classification Search

CPC ..... A47L 15/4261; E05F 15/627; E05F 1/14; E05F 1/1261; F24C 15/023

USPC ..... 312/400, 228, 311, 319.5, 319.8; 126/191, 192, 194

See application file for complete search history.

(56) References Cited

U.S. PATENT DOCUMENTS 4,765,666 A * 8/1988 Parks ..... E01H 1/006 15/79.2
5,546,773 A * 8/1996 Lee ..... D06F 39/14 160/188

(Continued)

FOREIGN PATENT DOCUMENTS

DE 102008022648 A1 11/2009
EP 0541974 A1 5/1993

(Continued)

OTHER PUBLICATIONS

Italian Search Report dated Jan. 2, 2017 from counterpart Italian App No. IT UA20162642.

*Primary Examiner* — James O Hansen
(74) *Attorney, Agent, or Firm* — Shuttleworth & Ingersoll, PLC; Timothy J. Klima

(57) ABSTRACT

An automatic system for actuating a door of an electrical domestic appliance comprising a frame and a door, the system comprising a first hinge body which can be fixed to the frame, a second hinge body, fixable to the door and connected to the first body to move in a tilting fashion between a first closed position, wherein the door is abutted to the frame, and a second open position, wherein the door is spaced from the frame, allowing access to a compartment of the electrical domestic appliance, means for moving the second body relative to the first body comprising an electric actuator and means for transmitting the motion from the actuator to the second body.

19 Claims, 6 Drawing Sheets

(51) Int. Cl.
*E05F 15/616* (2015.01)
*E05F 15/622* (2015.01)

(56) References Cited

U.S. PATENT DOCUMENTS

| | | | | |
|---|---|---|---|---|
| 6,679,572 | B2 * | 1/2004 | Sears | D06F 39/14 312/319.2 |
| 2004/0255929 | A1 * | 12/2004 | Miller | F24B 1/192 126/500 |
| 2007/0267401 | A1 | 11/2007 | Collene et al. | |
| 2009/0113803 | A1 | 5/2009 | Arenz | |
| 2011/0074261 | A1 * | 3/2011 | Assmann | A47L 15/4259 312/326 |

FOREIGN PATENT DOCUMENTS

| | | | |
|---|---|---|---|
| EP | 1738994 | A2 | 1/2007 |
| JP | 8240069 | A | 9/1996 |

* cited by examiner

ACTUATING SYSTEM FOR A DOOR OF AN ELECTRICAL DOMESTIC APPLIANCE

This application claims priority to Italian Patent Application No. 102016000039160 filed Apr. 15, 2016, the entirety of which is incorporated by reference herein.

BACKGROUND OF THE INVENTION

This invention relates to an actuating system for a door of an electrical domestic appliance and to an electrical domestic appliance equipped with the system.

This invention is applicable in particular to the production of electrical domestic appliances, especially (but not exclusively) those with doors which open by tilting, that is, by rotating about a horizontal axis, such as ovens or dishwashers.

SUMMARY OF THE INVENTION

Typically used in the prior art are door movement systems of elastic type, where a preloaded spring is connected by a suitable link mechanism to one edge of the door, close to the hinge point. It should be noted that for this reason, it is often necessary to use springs capable of providing particularly high resistance and return forces.

Although high-performing in terms of balance and drive movement, door systems of this kind always require manual force applied by the user to open and close the door.

To avoid manual action, the prior art proposes numerous solutions where the "spring-action" movement system is replaced by an electric drive.

For example, document US2007267401 describes a movement system equipped with two hinges, one spring operated and one motorized, both applied to the door of an oven.

Document JP8240069 also relates to an automatic opening/closing device applied to a door hinge. The device comprises a linear motor interposed between the frame and the door and acting directly on the door to allow the tilt opening movement.

Alternatively, patent document US2009113803 also relates to a device for opening/closing a door but equipped with rotary drive means configured to allow opening the door by means of a rotating motor and a mechanism of the lead screw type.

Disadvantageously, all the above-mentioned documents describe systems with actuators mounted close to the door hinge point and which therefore require high powered drives to overcome the disadvantage in terms of lever effect.

In light of this, these devices require large motors or drives and, considering the stringent dimensional constraints in the technical sector of electrical household appliances, this requirement gives rise to more than a few critical design issues, even in terms of costs.

Moreover, these solutions necessarily involve choosing either to increase the overall size of the appliance or to reduce its capacity.

In particular electrical domestic appliances, such as ovens, there is also the risk that the electric motors or actuators positioned close to the hinges are adversely affected by the high temperatures reached there.

This invention therefore has for an aim to overcome the above-mentioned disadvantages of the prior art.

More specifically, an aim of the invention is to provide an actuating system for a door of an electrical domestic appliance of an automatic type which does not affect the overall dimensions or capacity of the appliance.

Another aim of the invention is to provide an electrical domestic appliance equipped with an automatic means for opening/closing the door and which is simple and inexpensive to make.

The technical features of the invention according to the above-mentioned aims may be easily inferred from the present disclosure.

BRIEF DESCRIPTION OF THE DRAWINGS

The advantages of the present invention are more apparent from the detailed description which follows, with reference to the accompanying drawings which illustrate a preferred embodiment of the invention provided merely by way of example without restricting the scope of the inventive concept, and in which.

DESCRIPTION OF THE PREFERRED EMBODIMENTS

Figure 1:
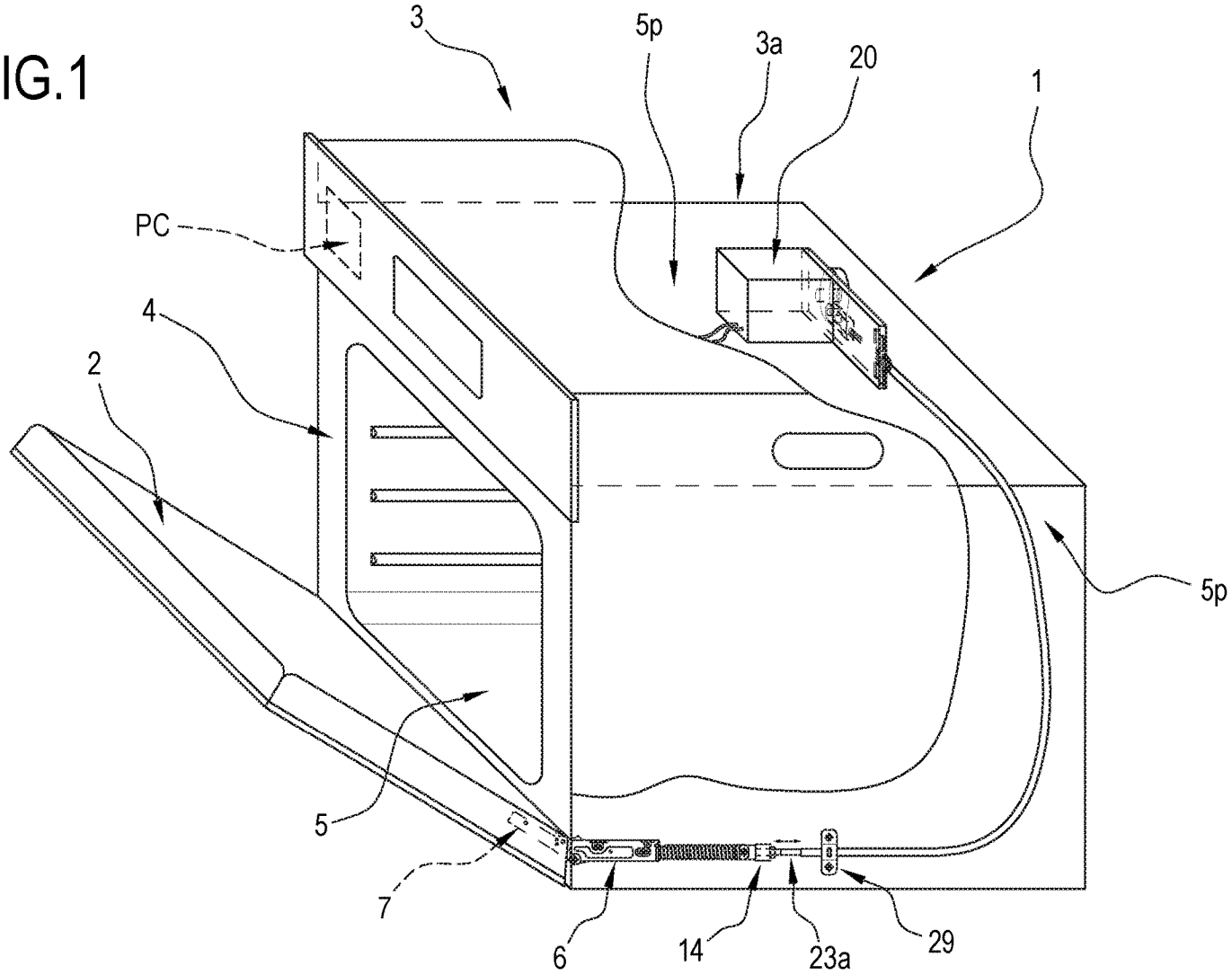
FIG. 1 is a schematic perspective view with some parts cut away and others in transparency of an electrical domestic appliance equipped with a first embodiment of the system for automatic actuation of the door made according to this invention.

As illustrated in the accompanying drawings, the numeral 1 denotes in its entirety an automatic actuating system for a door 2 of an electrical domestic appliance 3, made in accordance with this invention.

The electrical domestic appliance 3, by way of example shown in the accompanying FIGS. 1 to 4 by an oven, comprises a frame 4, an operating compartment 5 and, precisely, a door 2, designed to close the above-mentioned operating compartment 5.

The operating compartment 5, in the case of an oven such as that illustrated in the accompanying drawings, has a plurality of perimeter containment walls 5*p*, designed to guarantee to the compartment 5 a predetermined thermal insulation.

With reference to the various embodiments illustrated, the automatic movement system 1 comprises a first hinge body 6 attachable to the frame 4 and a second hinge member 7, fixable to the door 2.

The second hinge body 7 is connected to the first body 6 to move in a tilting fashion between a first closed position, not illustrated, wherein the door 2 is abutted to the frame 4 closing the operating compartment 5, and a second open position, illustrated in FIGS. 1 to 4, wherein the door 2 is spaced from the frame 4 and access to the compartment 5 of the electrical domestic appliance 3 is allowed.

Figure 6:
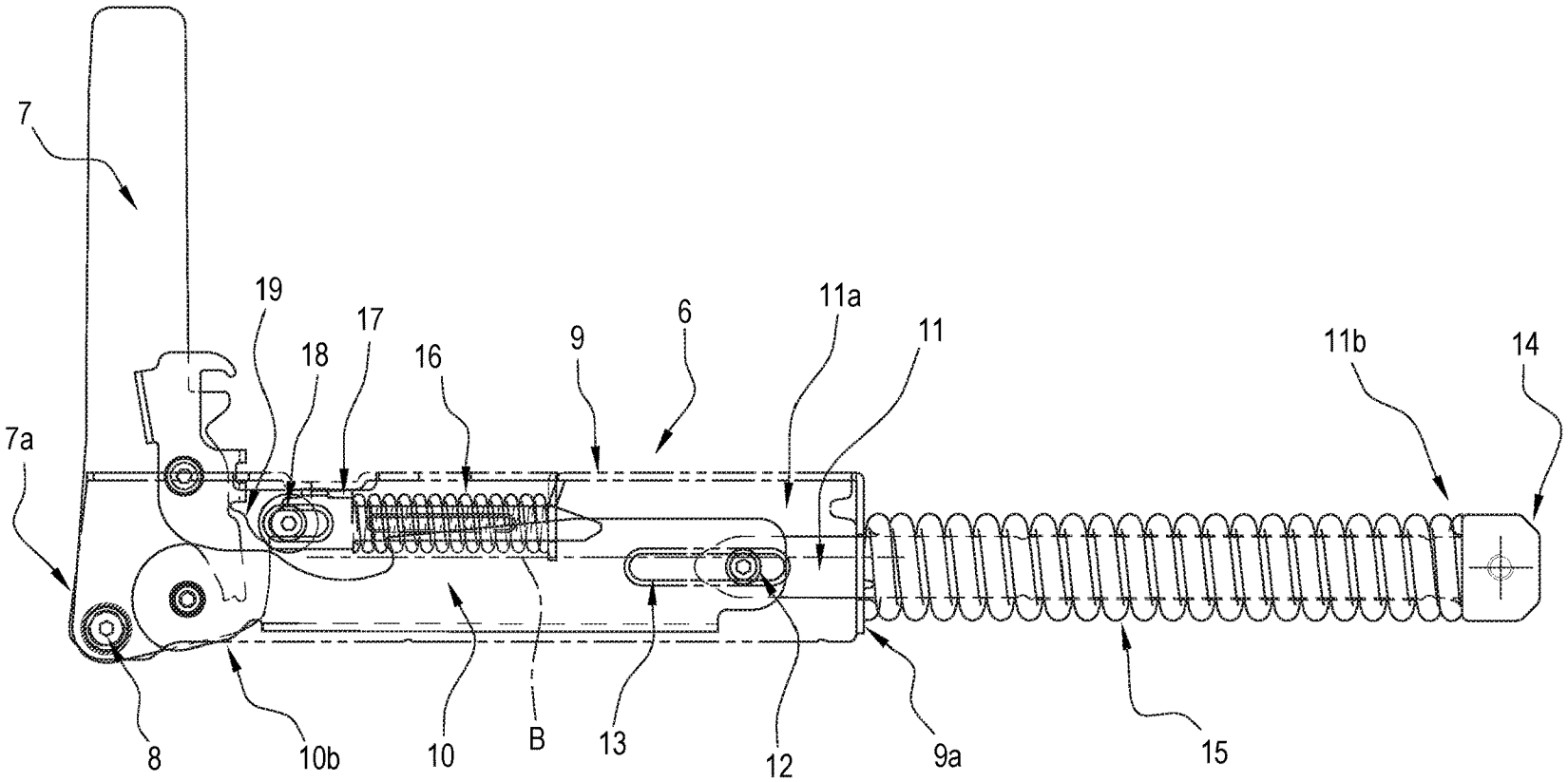
FIG. 6 is a schematic side elevation view, with some parts transparent, of a detail of the systems of the above-mentioned drawings.

In more detail, as illustrated in FIG. 6, the first and the second hinge body 6, 7 are connected by a kinematic mechanism using a first pin 8 to rotate relative to each other about an axis of the first pin 8.

The first hinge body 6 has a box-shaped structure 9 having a transversal cross-section which is substantially C-shaped and extends longitudinally along its own axis B.

The first hinge body 6 also supports a lever 10 and a rod 11 positioned longitudinally side by side along the above-mentioned axis B, and connected to each other, at respective first ends 10*a*, 11*a*, by means of a second connecting pin 12.

The second pin 12 is slidably inserted with the relative ends in respective longitudinal slots 13 made in the box-shaped structure 9 and of which slots only one is illustrated in the accompanying drawings.

The lever 10, at a relative second longitudinal end 10*b* opposite the above-mentioned first end 10*a*, is rotatably connected to a lower end 7*a* of the second hinge body 7.

The rod 11 is housed partly inside the box-shaped structure 9 and has, at a relative second end 11*b* longitudinally opposite the above-mentioned first end 11*a*, a head 14.

A first helical spring 15 is fitted in the stretch extending outside the box-shaped structure 9, around the rod 11, having respective end turns abutted against, respectively, the head 14 and a transversal wall 9*a* of the box-shaped structure 9.

The first helical spring 15 is designed to be stressed by compression.

The first helical spring 15 defines, for the system 1, an elastic element designed to generate a force for balancing the weight of the door 2 during the steps for opening and closing the door 2.

The system 1 comprises a second spring 16, housed inside the box-shaped structure 9, supported by a respective rod 17. By means of a roller 18 positioned at one end of the rod 17, the second spring 16 interacts with a cam profile 19 made on the second hinge body 7.

The interaction is designed to generate, at the closing of the door 2 and the corresponding compression of the second spring 16, an accumulation of elastic energy designed to provide, when required, a push for opening the door 2.

As illustrated in FIGS. 1 to 4, the actuating system 1 comprises an electric actuator 20 positioned in an upper zone 3*a* of the electrical domestic appliance.

The electric actuator 20 is advantageously a rotary electric motor and is connected, by a member 21 for transformation of the rotary movement into linear movement, to a flexible member 22 for transmitting the motion operatively connected to the above-mentioned head 14 of the rod 9 at a relative first end 22*a*.

The above-mentioned flexible member 22 for transmitting the motion is of the double-acting type, pulling and pushing, also known as Bowden Cable.

The flexible member 22 for transmitting motion comprises a metal cable 23 and an outer sheath 24, both flexible, the metal cable 23 sliding inside the sheath 24 in both sliding directions.

The sliding of the metal cable 23 inside the sheath 24 causes a corresponding longitudinal movement of the rod 9 and, consequently, the movement of the second hinge body 7 relative to the first hinge body 6 between its two open and closed limit positions.

The metal cable 23 is connected to the head 14 of the rod 9 at a relative first end 23*a*.

The closed position of the second hinge body 7 is illustrated in FIG. 6.

Figures 3, 3A:
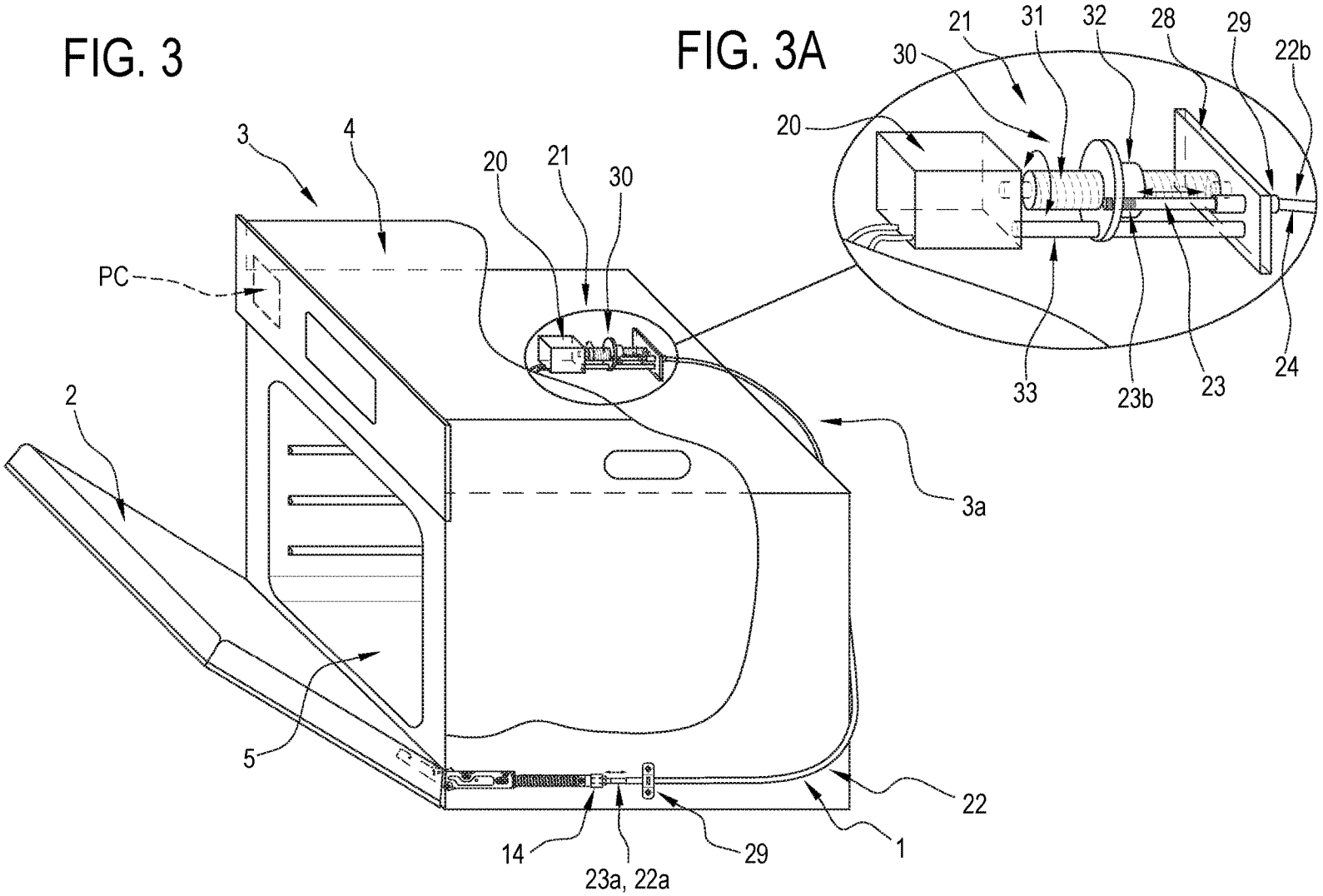
FIG. 3*a* is a scaled-up view of a detail of the system of FIG. 3.
Figure 4:
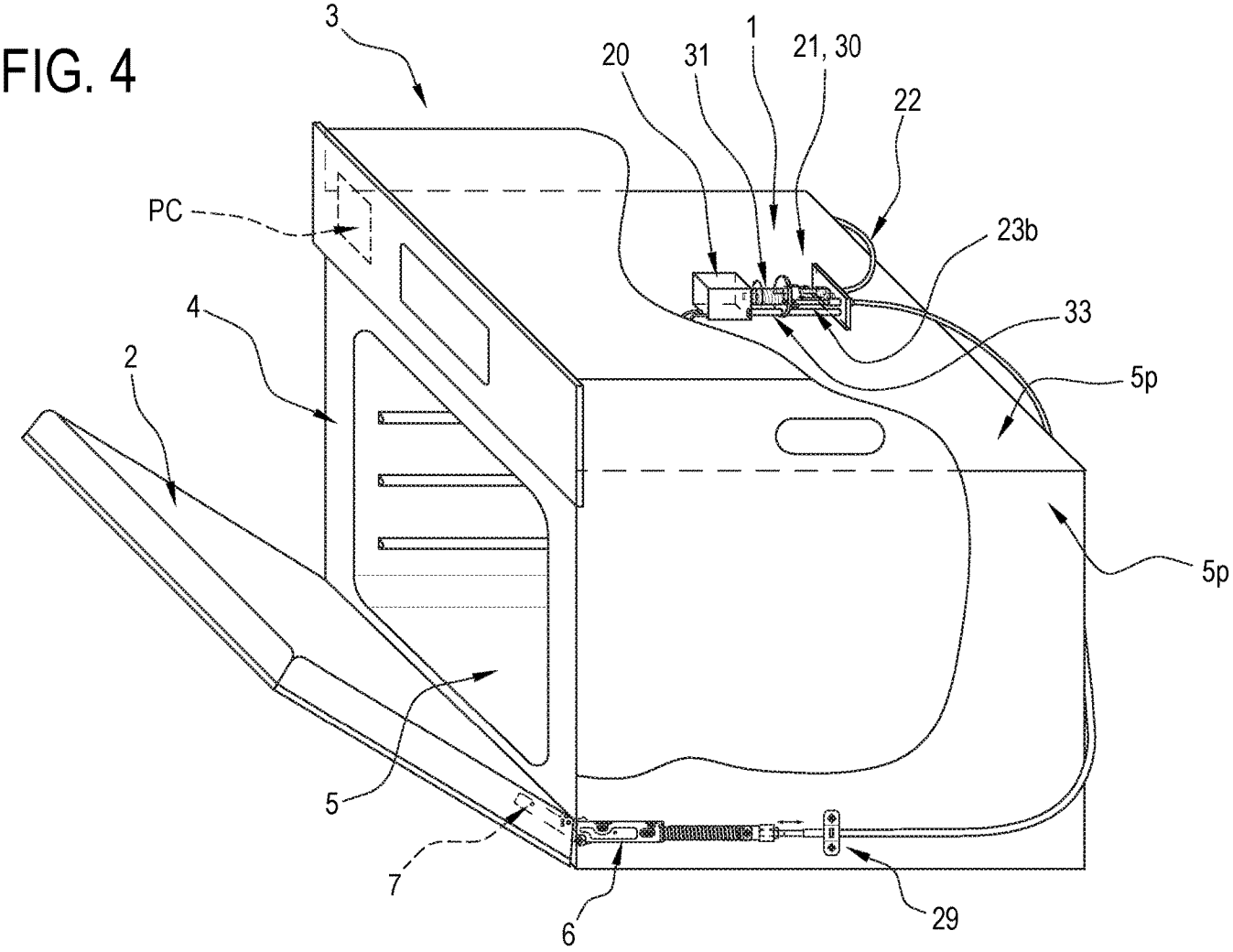
Figure 5:
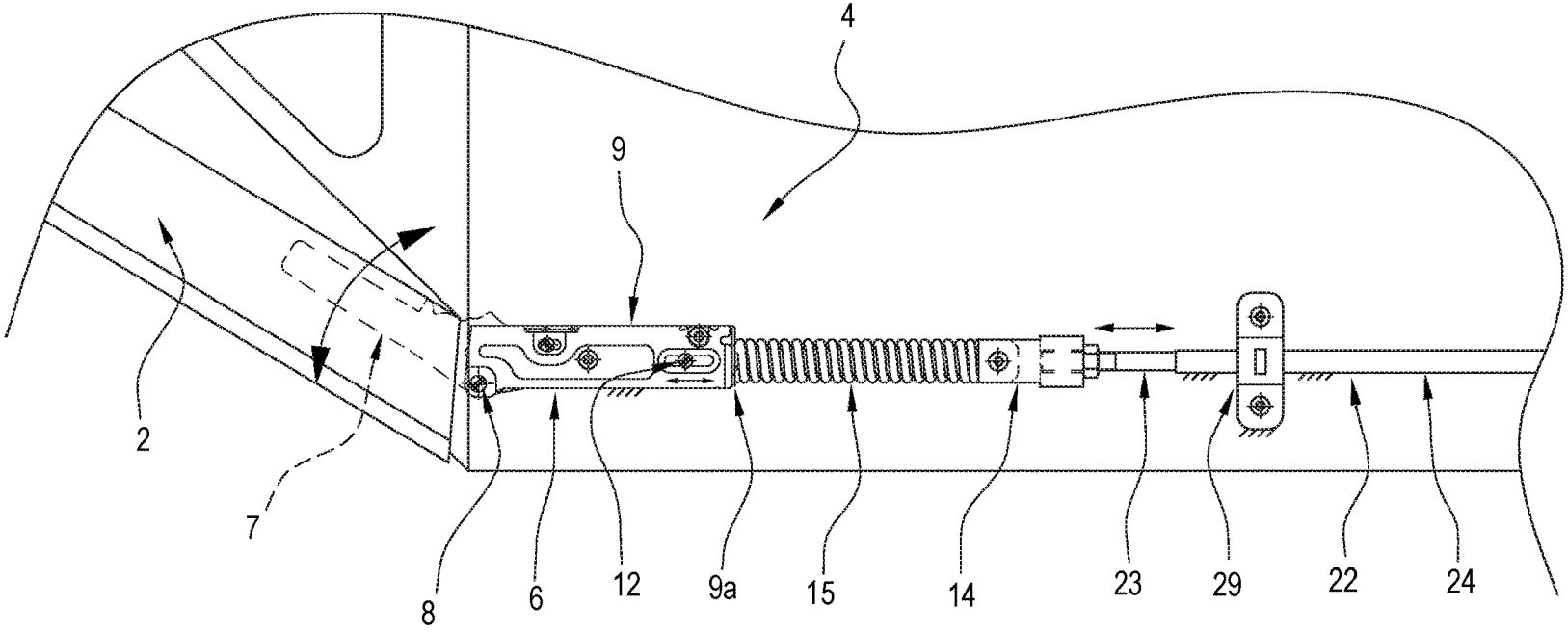
FIG. 5 is a scaled-up view of a detail shared by the systems of FIGS. 2 to 4.

An open position of the second hinge body 7, not necessarily end position, is illustrated in FIG. 5 and in FIGS. 1 to 4.

Figure 2A:
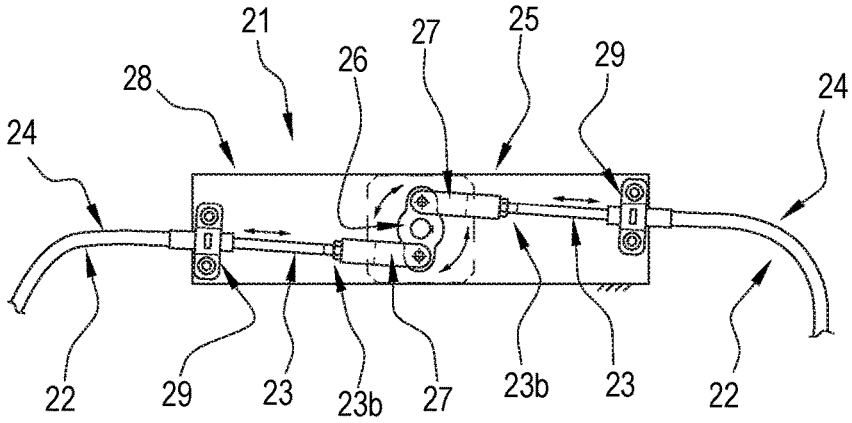
FIG. 2*a* is a schematic scaled-up front elevation view of a detail of the system of FIG. 2.
Figure 2:
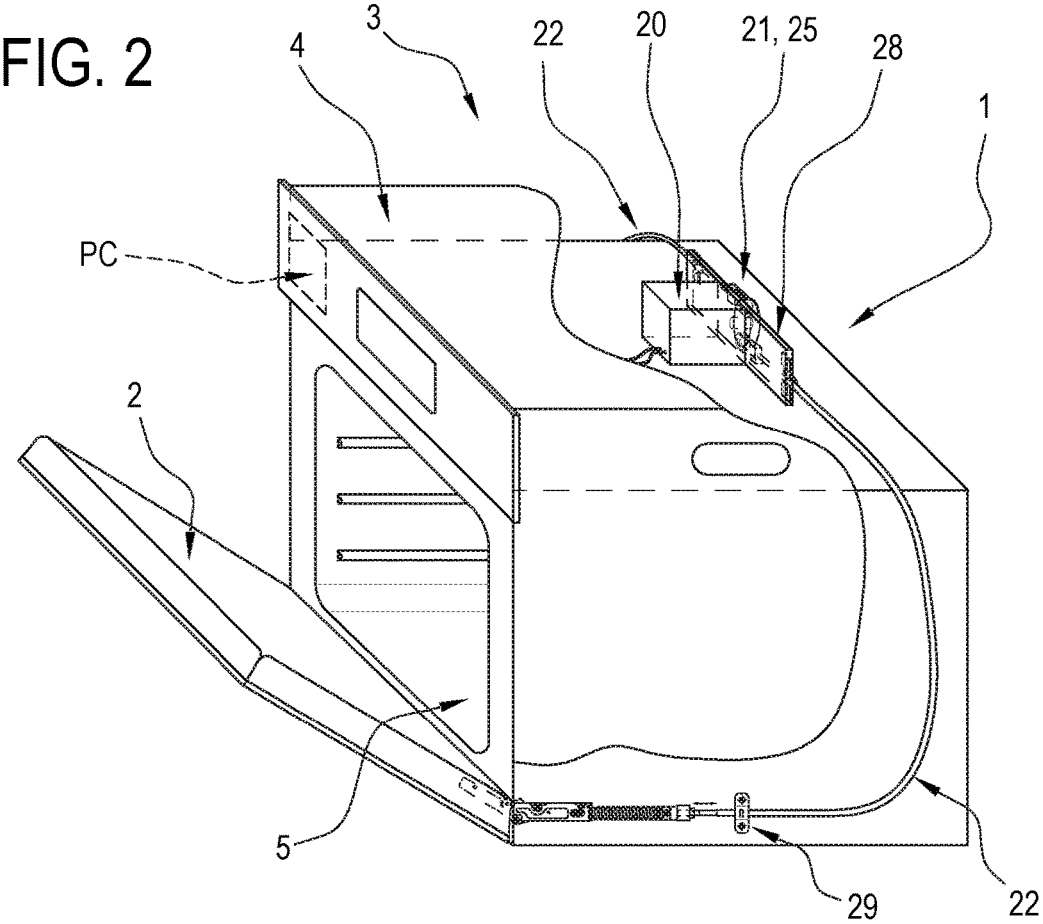
FIGS. 2 to 4 are schematic perspective views of three respective variant embodiments of the system of FIG. 1.

As illustrated in the accompanying FIGS. 1 and 2, the above-mentioned member 21 for transformation of the rotary movement into linear movement comprises a mechanism 25 of the connecting rod-crank type.

More specifically, as illustrated in FIG. 1, the connecting rod-crank mechanism 25 has a crank 26 on which a respective connecting rod 27 is pivoted in an eccentric position, rigidly connected at one end 23*b* of the metal cable 23 opposite the above-mentioned end 23*a* connected to the head 14. The crank 26 is supported rotatably by a plate 28 integral with the frame 4 of the electrical domestic appliance, a stop element 29 of the sheath 24 being positioned on the plate 28. The stop element 29 of the sheath is necessary, at both ends of the metal cable 23, to guarantee efficient operation of the flexible member 22 for transmitting motion.

On the other hand, as illustrated in FIG. 2, and in particular in the relative enlargement of FIG. 2*a*, the connecting rod-crank mechanism 25 has a crank 26 on which two respective connecting rods 27, rigidly connected to the same number of ends 23*b* of two metal cables 23, are pivoted in diametrically opposite eccentric positions. Only one of the two flexible members 22 for transmitting the motion is visible fully in FIG. 2.

FIG. 2*a* also illustrates, mounted on a supporting plate 28 integral with the frame, two elements 29 for stopping the sheath 24 of each of the two flexible means 22 for transmitting the motion, the stopping of the sheath 24 being necessary, as mentioned above, at both the ends 23*a*, 23*b* of the metal cable 23, to guarantee efficient operation of the flexible member 22.

As illustrated in the accompanying FIGS. 3, 3*a* and 4, the above-mentioned member 21 for transformation of the rotary movement into linear movement comprises lead nut and screw coupling 30.

More specifically, as illustrated in FIG. 3*a*, a threaded shaft 31 is keyed on the axis of rotation of the electric motor 20, defining the screw of the above-mentioned lead nut and screw coupling 30.

The threaded shaft 31 engages by screwing on an axially symmetric body 32 defining the lead nut of the lead nut and screw coupling 30, an end 23*b* of the metal cable 23 being fixed on the body 32 opposite to the above-mentioned end 23*a* connected to the head 14.

The threaded shaft 31 is supported rotatably by a plate 28 integral with the frame 4 of the electrical domestic appliance, a stop element 29 of the sheath 24 being positioned on the plate 28. Similarly to what is already indicated above, the stop element of the sheath is necessary to guarantee the efficient operation of the flexible member 22 for transmitting the motion.

A rod 33, connected at its opposite longitudinal ends both to the body of the electric motor 20 and to the plate 28 and extending parallel to the threaded shaft 31, is fitted slidably inside a hole made on the axially symmetric body 32. The rod 33 defines for the body 32 both a transversal guide element and an impediment to the rotation.

With reference to the embodiment illustrated in FIG. 4, the relative member 21 for transformation of the movement differs from that just described with reference to FIG. 3 due to the presence of two flexible members 22 whose respective metal cables 23 have the respective ends 23*b* both fixed to the axially symmetric body 32.

The above-mentioned electric actuator 20, member 21 for transforming rotary movement into linear movement and flexible members 22 for transmitting motion define, in their entirety for the system 1, means 34 for moving the second hinge body 7 relative to the first hinge body 6.

With reference to the embodiments of the system 1 according to the invention illustrated in FIGS. 2 and 4, the presence in them of two flexible members 22 is due to the fact that on both sides, that is, at each lateral end of the door 2, it is connected to the frame 4 with respective hinges moved using the above-mentioned movement means 34.

Alternatively, the embodiments of the system 1 of FIGS. 1 and 3 have a single hinge moved by the movement means 34.

The choice relating to the adoption of one or both of the hinges moved may depend on different parameters such as, for example, the weight of the door.

Advantageously, the electrical domestic appliance 3 comprises a control panel, schematically illustrated in FIGS. 1 to 4 by a block PC, positioned at a relative top-front portion thereof, the control panel PC housing an interface with the user configured to operate means, not illustrated, for controlling the electric actuator 20.

The above-mentioned and not illustrated interface may comprise, for example, a pushbutton or a video camera or also audio or optical sensors.

In use, with reference to the accompanying drawings 1 and 2, a rotation of the electric actuator 20 determines, by means of the connecting rod-crank mechanism 25, a simultaneous sliding of the metal cable 23 relative to the respective sheath 24, thereby causing a movement of the rod 11 according to the direction of the axis B.

On the other hand, with reference to FIGS. 3 and 4, the rotation of the electric actuator 20 determines the sliding of the metal cable 23 relative to the respective sheath 24, by means of the lead nut and screw coupling 30, also in this case causing a movement of the rod 11 according to the direction of the axis B.

The electric actuator 20 is advantageously located in an upper zone 3*a* of the electrical domestic appliance in such a way as not to obstruct the lateral extension of the operating compartment 5.

More specifically, in the case, as those illustrated, wherein the electrical domestic appliance 3 is an oven, the positioning of the electric actuator 20 in a remote position relative to the hinge bodies 6, 7 allows for the actuator not to be exposed to high temperatures which could damage it.

In the ovens, the upper zone is to all effects a cooler zone, where the rest of the electronics of the oven is also present and where ventilation is expressly provided, for that purpose.

The adoption of a system for actuating the door according to the invention allows for the electric actuator 20 to be poisoned in a remote position thanks to the adoption of flexible motion transmission means.

This position also allows for the adoption of electric actuators 30 with performance (and dimensions) greater than those which can be housed at the hinges of the door.

In other words, the first and second hinge body 6, 7 are positioned at a lower zone of the operating compartment 5, whilst the electric actuator 20 is positioned above the compartment 5, outside the above-mentioned perimeter walls 5*p*, as clearly illustrated in FIGS. 1 to 4.

Advantageously, the use of means 22 for transmitting motion of a flexible type and double-acting, pulling and pushing, allows simplified construction solutions, without the need for transmission means which are necessarily present in the case of metal cables acting only in traction.

According to a simplified variant embodiment, not illustrated, of the movement system according to this invention, the members 22 for transmitting motion comprise a metal cable 23 acting only by pulling on the second hinge body 7.

In other words, it is a metal cable 23 with a simple pulling effect.

This circumstance therefore implies that the movement means 34 act basically only during the step of closing of the door 2, the step of opening of the door 2 being performed also with normal methods typical of the systems with hinges without movement actuating members.

In other words, for example during the opening of the door 2, the second hinge body 7 moves relative to the first hinge body 6 basically thanks to the relative weight of the door 2, advantageously balanced by elastic elements.

During the above-mentioned opening step, the automatic movement system according to the simplified variant comprises, also not illustrated, means which are able to release a predetermined stretch of metal cable 23.

The metal cable 23 therefore intervenes operatively only during the step for closing the door 2 and, under the action of the electrical actuation movement means, applies a pulling action on the second hinge body 7.

In this description, the numeral 20 has denoted an electric actuator, meaning either an electric motor or a gear motor, that is to say, a motor combined with a reduction gear unit capable of introducing a predetermined reduction ratio between the shaft of the electric actuator 20 and the rotary motion transformation member 21. By way of example, with the embodiment illustrated in FIG. 2, use has been advantageously made, with good experimental results, of an epicyclic reduction gear unit, not illustrated, with 1:10 reduction ratio.

The solutions illustrated in FIGS. 3 and 4 have, on the other hand, the lead nut and screw coupling 30 which already in itself defines a reduction ratio, which can be advantageously modified by varying the pitch of the screw. The effectiveness of screws with a spacing of, respectively, 4 mm and 8 mm has been seen experimentally.

What is claimed is:

1. An automatic system for actuating a door of an electrical domestic appliance comprising a frame and a door, which is movable compared to the frame, the system comprising:

a first hinge body which can be fixed to the frame;

a second hinge body, which can be fixed to the door;

a hinge pivotally connecting the first hinge body to the second hinge body to allow the first hinge body to pivotally move between a first closed position, wherein the door is abutted against the frame and the second hinge body is positioned at a first angle to the first hinge body, and a second open position, wherein the door is spaced from the frame and the second hinge body is positioned at a second angle to the first hinge body, the second angle being different than the first angle, thus allowing access to an operating compartment of the electrical domestic appliance;

an actuating system for pivotally actuating the second hinge body with respect to the first hinge body, comprising:

an electric actuators; and a motion transmission member connected between the electric actuator and the second hinge body for transmitting motion from the electric actuator to the second hinge body, wherein the motion transmission member is flexible and includes a metal cable.

2. The automatic system according to claim 1, wherein the metal cable is double-acting, pulling and pushing.

3. The automatic system according to claim 1, wherein the motion transmission member includes a sheath for sliding the metal cable, the metal cable being slidable inside the sheath.

4. The automatic system according to claim 1, wherein the electric actuator is positioned in remote position compared to the first hinge body and the second hinge body.

5. The automatic system according to claim 1, wherein the electric actuator is a rotary electric motor, wherein the actuating system comprises a rotary motion transformation member for transforming rotary movement of the rotary electric motor into a linear movement of the metal cable.

6. The automatic system according to claim 5, wherein the rotary motion transformation member comprises a lead nut and screw coupling.

7. The automatic system according to claim 6, wherein the metal cable is double-acting, pulling and pushing.

8. The automatic system according to claim 5, wherein the rotary motion transformation member comprises a rod-crank mechanism, the metal cable defining a lead nut and screw coupling.

9. The automatic system according to claim 5, wherein:

the rotary electric motor includes a rotatable shaft which provides the rotary movement of the rotary electric motor;

the motion transmission member includes a rod connected to an end of the metal cable such that the linear movement of the rod causes the linear movement of the metal cable;

the rotary motion transformation member comprises a crank arm connected to the shaft of the rotary electric motor to rotate with the shaft;

the rod is pivotally connected to a portion of the crank arm positioned radially outwardly from an axis of the shaft, and aligned in a direction normal to the axis of the shaft, to transform the rotary movement of the shaft and crank arm into the linear movement of the rod and metal cable.

10. The automatic system according to claim 9, wherein the metal cable is double-acting, pulling and pushing.

11. The automatic system according to claim 5, wherein the metal cable is double-acting, pulling and pushing.

12. The automatic system according to claim 1, comprising a controller for controlling the electric actuator, the controller comprising an interface for a user.

13. An electrical domestic appliance comprising:

the frame, the operating compartment, the door, which is movable with respect to the frame to open and close the operating compartment, and the automatic system according to claim 1.

14. The electrical domestic appliance according to claim 13, wherein the door is tiltingly movable with respect to a horizontal axis, the first hinge body and the second hinge body being positioned at a lower area of the operating compartment, wherein the electric actuator is positioned above the operating compartment.

15. The electrical domestic appliance according to claim 14, wherein the operating compartment includes a plurality of perimeter containment walls providing a predetermined thermal insulation, wherein the electric actuator is positioned outside the perimeter walls.

16. The electrical domestic appliance according to claim 13, comprising a control panel positioned at a top-front portion of the electrical domestic appliance, wherein the control panel houses an interface for a user which is configured to activate a controller for controlling the electric actuator.

17. The automatic system according to claim 13, wherein the electric actuator is a rotary electric motor, wherein the actuating system comprises a rotary motion transformation member for transforming rotary movement of the rotary electric motor into a linear movement of the metal cable.

18. The automatic system according to claim 17, wherein:

the rotary electric motor includes a rotatable shaft which provides the rotary movement of the rotary electric motor;

the motion transmission member includes a rod connected to an end of the metal cable such that the linear movement of the rod causes the linear movement of the metal cable;

the rotary motion transformation member comprises a crank arm connected to the shaft of the rotary electric motor to rotate with the shaft;

the rod is pivotally connected to a portion of the crank arm positioned radially outwardly from an axis of the shaft, and aligned in a direction normal to the axis of the shaft, to transform the rotary movement of the shaft and crank arm into the linear movement of the rod and metal cable.

19. The automatic system according to claim 18, wherein the metal cable is double-acting, pulling and pushing.

* * * * *